US006318419B1

(12) United States Patent
Lee

(10) Patent No.: US 6,318,419 B1
(45) Date of Patent: Nov. 20, 2001

(54) COLLECTION SYSTEM AND METHOD

(76) Inventor: James W. Lee, 1628 W. Champlost St., Philadelphia, PA (US) 19141

( * ) Notice: Subject to any disclaimer, the term of this patent is extended or adjusted under 35 U.S.C. 154(b) by 0 days.

(21) Appl. No.: 09/796,887

(22) Filed: Mar. 2, 2001

(51) Int. Cl.[7] ..... B65B 1/04; B65B 3/04; B67C 3/02

(52) U.S. Cl. ..... 141/108; 141/114; 141/313; 141/314

(58) Field of Search ..... 141/10, 108, 114, 141/313, 314, 317, 391; 56/202; 383/17, 20, 100, 102, 103, 113, 109

(56) References Cited

U.S. PATENT DOCUMENTS 1,182,412 * 5/1916 Olesberg ..... 141/108
4,749,391 * 6/1988 DeMarco ..... 55/367
5,031,277 * 7/1991 Coker ..... 15/257.3
5,042,241 * 8/1991 Boylston et al. ..... 56/202

* cited by examiner

*Primary Examiner*—Timothy L. Maust
(74) *Attorney, Agent, or Firm*—Daniel J. O'Connor

(57) ABSTRACT

A collection system and method for various uses including the efficient collection of leaves. The system includes a specially designed chute element and an attachable draw-string type of plastic bag. The bag unit has plural perforations formed therein to provide for an equalization of air pressure and resultant ease of placement of collected items into the bag. The invention incorporates fluid mechanics principles related to air flow and air pressure equalization.

1 Claim, 1 Drawing Sheet

COLLECTION SYSTEM AND METHOD

BACKGROUND AND OBJECTS OF THE INVENTION

The present invention is generally related to collection devices and methods and, in particular, to a system and method for collecting leaves.

As is known in the art, leaves and other yard debris are traditionally collected and placed in bags for appropriate disposal.

This becomes something of a difficult and time-consuming operation especially for one person.

Various bag holders and supports have been used in the art. However, such have proven to be costly to manufacture and difficult to use in practice.

Accordingly, it is an object of the present invention to show a collection/storage device for leaves which may be easily used by one person.

It is also an object of the invention to demonstrate a collection and storage device which may be economically manufactured for widespread commercial appeal.

It is a further object of the invention set forth a novel bag subcombination which may be effectively used in combination with the leaf collection system described and for other uses as well.

These and other objects and advantages of the present invention will be appreciated by those of skill in the art from the description and drawings which follow.

SUMMARY OF THE INVENTION

The invention comprises a combined chute and bag system for various uses including the collection of leaves.

The chute includes a widened and curved intake portion for the efficient intake of articles such as leaves. The chute further includes a rear reinforced element for the attachment of a bag as desired.

A draw-string bag forms part of the system and includes plural perforated openings to permit equalization of air pressure and reduce clinging of the bag walls together.

The bag subcombination, including the use of plural wall openings, has utility for the collection of other items besides leaves.

BRIEF DESCRIPTION OF THE DRAWING FIGURES

FULL DESCRIPTION OF A PREFERRED EMBODIMENT

Figure 1:
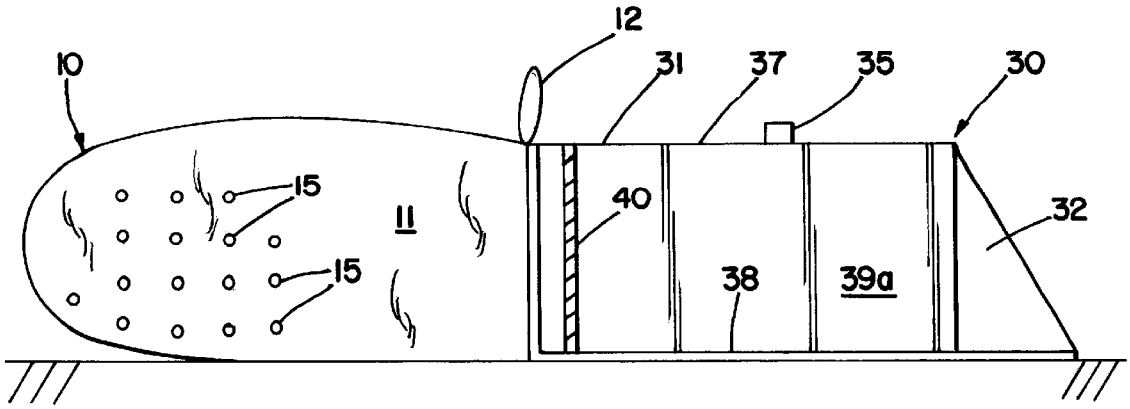
FIG. 1 is a side view of the combined chute and bag elements and illustrates the operating method and air pressure equalization aspects of the invention.

Referring to the drawing figures, FIG. 1 is a side view of the overall collection system.

The plastic bag 10 has side walls 11 and a draw string 12 and is of a type manufactured by the Glad Products Company and other manufacturers.

For practical use with this particular invention, plural apertures or openings 15 are formed in the bag walls 11 to allow air flow into and out of the bag.

Figure 2:
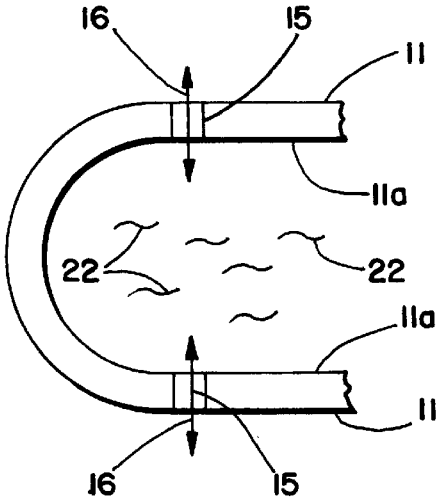
FIG. 2 is an enlarged view of a portion of the plastic bag and shows the plural apertures to allow air flow into and out of the bag.

As shown in the enlarged view of FIG. 2, the bag has exterior and interior walls 11 and 11*a* with apertures 15 formed therethrough to permit an air flow into and out of the bag as indicated by arrows 16. Leaves 22 are contained in the bag.

The air flow 16 helps the walls 11 to spread apart by reducing cling inherent in the plastic. Thus, the leaves 22 are more easily pushed into the bag and the bag can be more completely filled.

Figure 3:
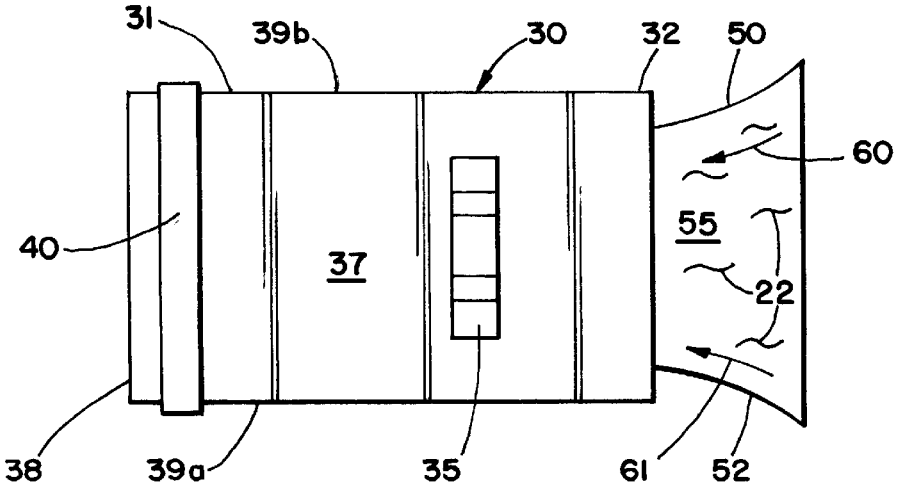
FIG. 3 is a top view of the intake chute and illustrates the various features thereof.

FIGS. 1 and 3 show the chute portion of the combined invention.

The chute 30 has rear and front ends 31 and 32 respectively. It further includes an upper handle 35 mounted on a top wall 37. Lower and side walls are indicated at numerals 38, 39*a* and 39*b*.

As shown in the top view of FIG. 3, the front end of the chute 32 includes curved intake walls 50 and 52 and a lower wall 55 extending between the curved intake walls.

The curved intake walls 50 and 52 result in a venturi effect to increase air flow and velocity as indicated by arrows 60 and 61. Thus, the leaves 22 are more rapidly and efficiently pushed into the chute and eventually into the bag 10.

The rear end of the chute 31 has a reinforced or built-up portion 40 formed thereon so the bag 10 can be easily mounted on and retained to the chute 30 by means of the draw string 12 shown in FIG. 1.

In practice of the invention, the method steps involved would be as follows:

a) forming air holes or apertures 15 in a draw-string type of plastic bag 10, b) securing the plastic bag to the rear end 31 of a chute 30, c) raking or blowing leaves 22 into the front of chute 30 and eventually into the bag 10.

The chute materials would comprise plastics, metals or other equivalent materials known in the fabrication arts.

It is contemplated that the apertures 15 could be formed in the bag 10 in the factory and the resulting product sold specifically for leaf collection.

Such an apertured plastic bag could be used by itself, i.e. without the attached chute, for the collection of other types of solid materials where leakage is not a problem.

While a particular system and method have been shown and described herein, it is intended in this specification to cover all equivalent systems and methods which would reasonably occur to those of skill in the art.

The invention is further defined by the claims appended hereto.

I claim:

1. A chute and bag system for collecting leaves and other debris, said chute and bag being positioned on and in contact with a ground surface and being devoid of any attachment to a lawn mower or equivalent machinery, wherein the chute(30) has a front end(32) and a rear end(31), wherein the chute front end(32) has fixed and curved intake walls(50,52) to provide a Venturi effect for incoming leaves and debris, said chute front end further including a lower wall(55) extending between said fixed and curved intake walls (50,52), wherein the area above said chute front end lower wall (55) is completely open and devoid of handles or other equipment thus providing a more efficient intake to the chute and bag system, wherein the rear end(31) of said chute(30) comprises a generally rectangular area for economy of manufacture and includes a lower wall(38) and side walls(39*a*,39*b*) attached to said lower wall, said chute rear end(31) further including a top wall(37) having a handle means(35) mounted at approximately one-third of the distance along said chute rear end(31) to provide optimal lifting efficiency for the chute and bag combination, wherein said chute rear end(31) further includes a built-up or reinforced portion(40) formed at a rear edge thereof to provide for attachment and retention of a draw-string type plastic bag(11), wherein said plastic bag(11) has plural holes or apertures (15) formed therein, said plastic bag(11) having a first end for attaching to said chute(30), a draw string(12) on said first end and a second end which is permanently closed to retain the leaves and debris.

* * * * *